US005921292A

United States Patent [19]

Fouts

[11] Patent Number: 5,921,292

[45] Date of Patent: Jul. 13, 1999

[54] OIL CHANGE KIT APPARATUS

[76] Inventor: Jerry N. Fouts, P.O. Box 213, Mathews, La. 70375

[21] Appl. No.: 09/081,724

[22] Filed: May 20, 1998

Related U.S. Application Data

[60] Provisional application No. 60/047,232, May 20, 1997.

[51] Int. Cl.[6] ..... B65B 1/04

[52] U.S. Cl. ..... 141/98; 141/86; 141/88; 141/331; 141/340; 141/341; 141/342; 141/363; 141/364; 141/369; 184/106

[58] Field of Search ..... 141/86, 88, 98, 141/104, 106, 331, 334, 340, 341, 342, 266, 268, 363, 364, 369, 378; 184/1.5, 106

[56] References Cited

U.S. PATENT DOCUMENTS

| | | | |
|---|---|---|---|
| 268,665 | 4/1882 | Hartwell | 141/334 |
| 1,951,498 | 3/1934 | Whitney | 184/1.5 |
| 1,994,844 | 3/1935 | Winger et al. | 184/1.5 |
| 2,021,585 | 11/1935 | Zarovy | 184/1.5 |
| 2,576,154 | 11/1951 | Trautvetter | 141/341 |
| 3,667,573 | 6/1972 | Edwards | 184/1.5 |
| 4,274,645 | 6/1981 | Ferguson et al. | 280/47.26 |
| 4,559,984 | 12/1985 | Wycech | 141/340 |
| 4,638,841 | 1/1987 | Heath | 141/98 |
| 5,172,739 | 12/1992 | Ristroph | 141/98 |
| 5,259,426 | 11/1993 | Burleigh et al. | 141/98 |
| 5,301,724 | 4/1994 | Maxwell | 141/98 |
| 5,375,862 | 12/1994 | Sirianno | 141/88 |

*Primary Examiner*—David J. Walczak
*Assistant Examiner*—Timothy L. Maust
*Attorney, Agent, or Firm*—Garvey, Smith, Nehrbass & Doody, L.L.C.

[57] ABSTRACT

An oil change kit apparatus includes a cylindrically-shaped pan that supports a bracket at its upper annular surface. The bracket has a threaded bushing that receives an externally threaded stem of a funnel, the stem having a hollow open ended flow bore. The funnel adjusts in elevation relative to an underlying support surface, floor, etc. by rotation of the funnel relative to the bracket.

11 Claims, 1 Drawing Sheet

OIL CHANGE KIT APPARATUS

CROSS-REFERENCE TO RELATED APPLICATIONS

Priority of U.S. Provisional Patent Application Ser. No. 60/047,232, filed May 20, 1997, incorporated herein by reference, is hereby claimed.

BACKGROUND OF THE INVENTION

1. Field of the Invention

The present invention relates to oil change and oil recycling devices for changing and/or recycling vehicle fluids such as motor oil, transmission fluid, and the like. More particularly, the present invention relates to an improved oil recycling kit apparatus that uses a cylindrically-shaped receptacle pan to which is affixed a bracket comprised of a plurality of radially extending, inclined struts that support a threaded bushing, the bushing receiving a wide neck funnel having external threads that fit the bushing of the bracket wherein the funnel adjusts into multiple elevational positions relative to the bracket and the underlying drain pan.

2. General Background of the Invention

Many mechanics and individuals change the oil of a motor vehicle by removing the bolt and allowing the oil to drain into a bucket, pan, or receptacle. This creates a problem because the drain plug of the vehicle engine typically falls into the bucket or pan splashing oil on the mechanic, individual, adjacent supporting floor surface, etc. Further, vehicles vary in there ground clearance so that a need exists for an adjustable oil change apparatus that compensates for the difference in elevation between the supporting underlying floor and the oil pan bolt that is used to drain the oil.

Several patents that issued for receptacle arrangements that catch oil from a vehicle are from another source. The Whitney patent, 1,951,498 discloses a "receptacle" that is said to receive crank case oil from an automobile that is lifted some distance above the ground.

The Winger et al. patent 1,994,844 shows a wheeled receptacle that is said to be a draining apparatus designed for draining the crank cases of automobiles. The apparatus is said to be readily moved into and out of a position beneath the crank case of an automobile and which can be adjusted vertically to accommodate the same to the height of the draining opening of the crank case.

U.S. Pat. No. 3,667,573, issued to Edwards, provides a drain spout attachment for an automobile crankcase oil drainage receptacle of the type having an upright collection tank with an upwardly opening funnel at its upper end and adapted for collecting drainage oil from the crankcase of an automobile elevated on a hoist. The spout attachment mounts on and projects horizontally from the funnel rim in a manner such that the receptacle may be placed below the automobile with the spout projecting over the hoist frame member which normally underlies the automobile crankcase drain opening to permit location of the spout directly below the drain opening.

An easy drain oil collection tank for use in an automobile service station is disclosed in U.S. Pat. No. 4,274,645. The device includes a thirty gallon tank mounted on a hand cart, a drain valve at the bottom of the tank, a screen covered funnel extending telescopically upward from the cover of the tank and an oil level gauge in the tank.

A device for handling fluids drained from vehicles is disclosed in U.S. Pat. No. 4,638,841, issued to Thomas Heath. The Heath patent includes a fluid storage tank, a container for holding fluid to be recycled, a funnel having an anti-splash mat positioned therein to prevent the splashing of fluid being drained, and a valve means operative to direct the fluid to either the storage tank or to the recycle container for subsequent reintroduction into the vehicle. The valve means also includes means for connecting an air compressor to the storage tank so that compressed air may enter the tank and expel the fluid therefrom through a hose. The storage tank is mounted on casters for mobility and the size of the funnel's opening is sufficiently large to capture fluid flowing from widely spaced sources.

A waste liquid transfer device is the subject of U.S. Pat. No. 5,172,739, issued to Michael Ristroph. The Ristroph patent shows a waste-liquid transfer device in a first embodiment, that includes a receiver assembly having a horizontal bottom wall and a vertical side wall integral with the bottom wall, providing a receiver cavity for temporarily holding the waste liquid. The vertical side wall defines a cylinder concentric with a standard fifty-five-gallon drum having a top with an opening in it. The receiver assembly fits snugly over the top of the drum, and a drain tube extending downward from the bottom wall fits into the opening in the top of the drum. In a second embodiment, the device includes a receiver assembly having a horizontal bottom wall and a vertical side wall integral with the bottom wall, providing a receiver cavity for temporarily holding the waste liquid. The device further includes a drain pipe leading from the receiver assembly to a storage tank, and a frame supporting the receiver assembly during the transfer operation.

An oil drain funnel for directing oil or transmission fluid from the oil pan or transmission of a vehicle to a collection pan or receptacle is the subject of U.S. Pat. No. 5,259,426, issued to James Burleigh and Roger Burleigh. The '426 patent discloses a drain funnel characterized by a tapered body portion having a top rim which mounts multiple socket supports that support a socket in the center of a circle defined by the top rim. The socket is fitted with a plug receptacle or with threads for receiving a companion threaded plug receptacle for engaging an oil pan, crankcase or transmission drain plug on the vehicle and seating the drain plug in the plug receptacle or in a recessed cage in the plug receptacle to prevent the drain plug from falling through the funnel. In a preferred embodiment a funnel nipple is provided at the bottom end of the tapered funnel body and is threaded to receive a drain hose for draining the oil or transmission fluid into the collecting pan or receptacle.

An oil collecting and dispensing apparatus is the subject of U.S. Pat. No. 5,301,724 issued to Maxwell. The apparatus is sized so as to fit under most vehicles when resting on one side thereof and is provided with a pivoting extensible arm having a funnel mounted on the end thereof for collecting the fluid that is mounted in a recess in one side thereof so as not to catch on the undercarriage of the vehicle when slid under or out from under the vehicle. Once positioned, the funnel is raised into close approximation with the oil drain plug, oil filter neck, or other location from which fluid is to be collected, and the fluid is drained into the funnel and directed down through the arm into the container. The container is then stood upright for dispensing the stored oil or other fluid through a valve, which is also recessed in the container, into a larger recycling or other collection facility.

BRIEF SUMMARY OF THE INVENTION

Most of the prior art oil change devices are complicated devices that use large vessels with valves to remove the oil. Further, many are configured so that they are only usable when a vehicle is elevated such as with a commercial automobile lift.

Others in the prior art are expensive and complicated constructions that render them acceptable to only large, commercial users such as automobile service stations. Such devices are of little utility to individuals that want to change the oil of their vehicles. Yet other prior art designs have so many working parts that they would be expensive to manufacture.

The apparatus of the present invention solves the problems confronted in the art in a simple and straightforward manner. What is provided is an oil change and oil recycling device that has an elevational adjustment in the form of a funnel with external threads that fits a specially shaped support member. The support member removably fits upon a large receptacle base with a specially configured pour spout and screen.

The present invention thus provides an improved apparatus for enabling an individual to change the oil of his or her vehicle and to dispose of or recycle that oil with minimal risk of spillage.

The apparatus of the present invention is comprised of three basic working parts, including the lower receptacle base which is cylindrically shaped and sized to hold 5–10 quarts of oil.

The second working member of the apparatus is a funnel having a wider open top portion that fits against the vehicle oil pan during use and a smaller diameter elongated stem that extends below the upper end portion.

The third portion of the apparatus is a conically shaped support member that forms an interface in between the receptacle base and the funnel.

The present invention thus provides an improved oil change apparatus for use when changing the oil and oil filter of an oil lubricated vehicle engine.

The apparatus includes a receptacle base that can be cylindrically shaped, providing a bottom and a cylindrically shaped side wall with an interior for containing oil that is drained from the vehicle engine. The side wall provides an upper annular edge.

A plurality of shelves can optionally be placed on the interior of the receptacle base. One of the shelves can preferably be in the form of a screen that can carry the engine oil filter and/or drain plug. The other of the shelves can be a shelf that fits against the wall of the receptacle base, providing an opening that defines a pour spout. This enables the user to pour any contained oil back into the original containers or other containers for recycling.

The conically shaped support removably fits the upper annular edge of the receptacle base. Thus, the conically shaped support provides a lower, enlarged diameter portion that approximates the diameter of the receptacle base and an upper, smaller diameter portion that is sized to receive the stem of the funnel.

The funnel thus, adjustable fits the conically shaped support at a providing bushing. The bushing is cylindrically shaped and has internal threads that correspond to the external threads of the funnel. By rotating the funnel, the threads are helically shaped so as to raise or lower the funnel relative to the base, depending upon the direction of rotation.

The funnel stem is thus movable into multiple, vertically spaced apart positions that vary the elevation of the catch basis relative to the bottom of the receptacle base.

When a user has completed the draining of an oil from an engine, both the conically shaped support and funnel can be removed from the receptacle base so that they do not interfere with a transfer of oil from the receptacle base to recycling containers.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
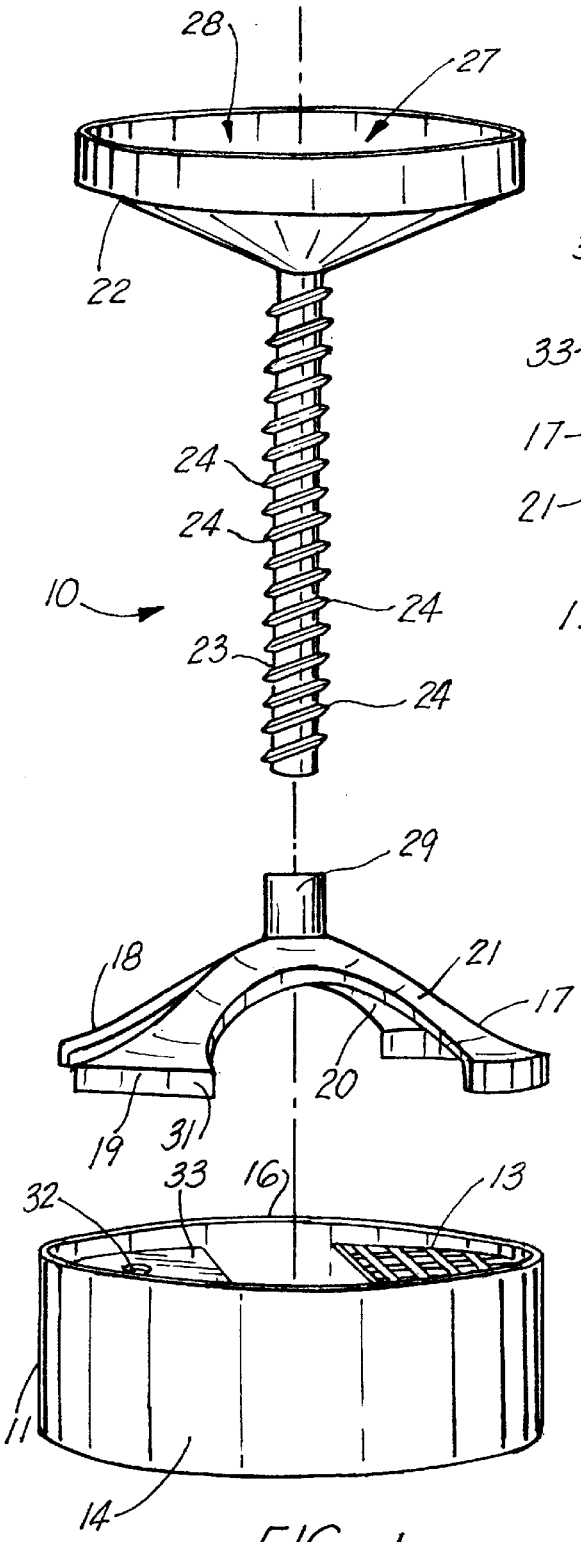
FIG. 1 is a perspective exploded view of the preferred embodiment of the apparatus of the present invention.
Figure 2:
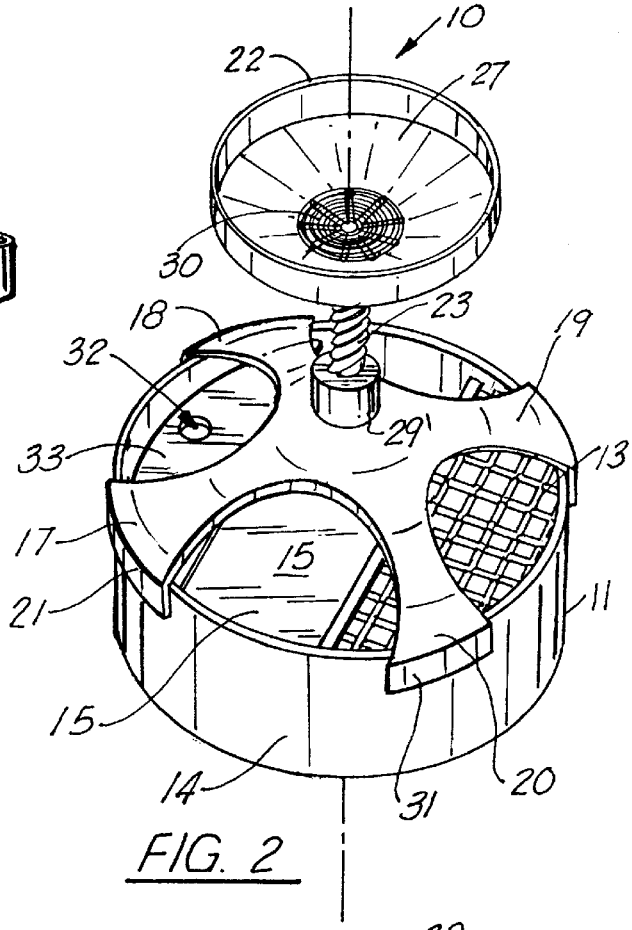
FIG. 2 is a perspective view of the preferred embodiment of the apparatus of the present invention.
Figure 3:
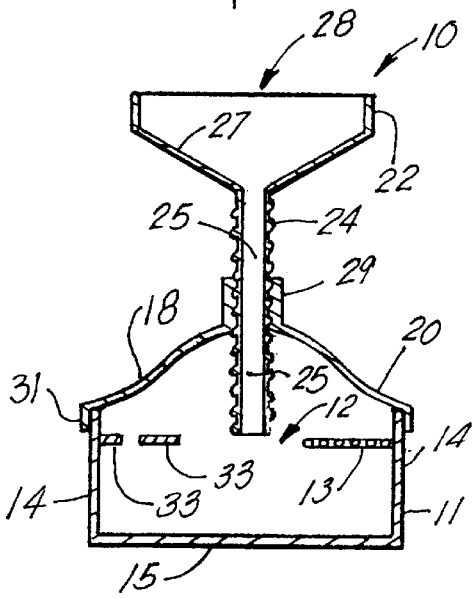
FIG. 3 is a sectional elevational view of the preferred embodiment of the apparatus of the present invention.

FIGS. 1–3 show the preferred embodiment of the apparatus of the present invention designated generally by the numeral 10 in FIGS. 1–3.

An oil change kit apparatus includes an oil pan 11 having an open top 12 that is fitted with a semi-circular screen 13 for holding an oil filter. The pan 11 can be of a cylindrical shape, having a cylindrical side wall 14 and a circular bottom 15 defining an interior for holding oil.

A top annular edge 16 tracks a circle and provides a surface for the attachment of bracket 17 thereto. The bracket 17 simply rests upon the top annular edge 16. Bracket 17 has a plurality of preferably four radially extending, inclined struts 18, 19, 20 21. A space can be provided in between adjacent struts (such as 18 and 19) as shown. The struts 18, 19, 20, 21, each include a lower end portion with a vertical lip 31 that is sized and shaped to fit and rest upon the top annular edge 16 and closely conform to wall 14 when the bracket 17 is placed on the pan 11.

A funnel member 22 includes a hollow cylindrical neck 23 having external threads 24 and an open ended preferably cylindrically-shaped flow bore 25 that extends the full length of funnel 22. The funnel 22 has an upper catch pan 27 with an open top 28. The catch pan 27 communicates with open ended flow bore 25 of hollow neck 23. Bolt guard screen 30 prevents the drain plug or drain bolt of an engine from entering the open ended flow bore 25.

Bracket 27 has an internally threaded bushing 29 that has an internally threaded bore with threads that (see FIGS. 1–3) correspond to and engage the threads 24 of hollow neck 23 so that rotation of the funnel 22 changes elevation of the funnel relative to the bracket 17 and the supporting pan 11.

The pan 11 can be used to dispose of oil via pour spout opening 32. The pour spout opening 32 can be in the form of a shelf or plate 33 attached to the upper portion of wall 14 of pan 11. The shelf 33 simply provides a circular opening 32 through which oil can be poured. In this fashion, the shelf 33 prevents spillage during the pouring of oil therefrom.

The following table lists the parts numbers and parts descriptions as used herein and in the drawings attached hereto.

PARTS LIST

| Part Number | Description |
|---|---|
| 10 | oil change apparatus |
| 11 | oil drain pan |
| 12 | open top |
| 13 | semi-circular screen |
| 14 | cylindrical side wall |
| 15 | bottom |
| 16 | top annular edge |

-continued

PARTS LIST

| Part Number | Description |
|---|---|
| 17 | bracket |
| 18 | radial inclined strut |
| 19 | radial inclined strut |
| 20 | radial inclined strut |
| 21 | radial inclined strut |
| 22 | funnel |
| 23 | hollow cylindrical neck |
| 24 | threads |
| 25 | open ended flow bore |
| 26 | oil |
| 27 | catch pan |
| 28 | open top |
| 29 | internally threaded bushing |
| 30 | bolt guard screen |
| 31 | vertical lip |
| 32 | pour opening |
| 33 | shelf |

The foregoing embodiments are presented by way of example only; the scope of the present invention is to be limited only by the following claims.

I claim:

1. An oil change kit apparatus for use when changing the oil and oil filter of an oil lubricated vehicle engine, comprising:

a) a receptacle base having a bottom, sidewall and interior for containing oil that is drained from a vehicle engine, the sidewall having an upper annular edge;

b) a plurality of shelves that extend from the sidewall next to the annular edge, at least one of the shelves having a drain opening therethrough for allowing oil to flow throughout the shelf at the drain opening, the shelf being sized and shaped to hold an oil filter;

c) a conically-shaped support that is supported by the receptacle, the support having a central hub and a plurality of radially extending, circumferentially spaced struts extending from said hub;

d) the hub having a central opening;

e) a funnel that adjustably fits the hub central opening, the funnel having an elongated stem portion of a first smaller diameter with a hollow bore, and a upper end portion of an second, larger diameter funnel mounted on the top of the stem portion, the funnel having an inner catch basin that communicates with the stem bore so that fluids draining from an automobile engine into the catch basin can travel via the stem bore to the receptacle base; and f) the funnel stem being movable into multiple, vertically spaced apart positions that vary the elevation of the catch basin relative to the bottom of the receptacle base.

2. The oil change kit apparatus of claim 1 wherein the stem threadably engages the hub at the central opening.

3. The oil change kit apparatus of claim 1 wherein the funnel has a screen to prevent an oil pan drain plug from entering the stem hollow bore.

4. The oil change kit apparatus of claim 1 wherein the funnel stem has a bore defined as a smooth cylindrically shaped inner surface of the stem.

5. The oil change kit apparatus of claim 4, wherein the external surface of the stem is at least partially threaded.

6. The oil change kit apparatus of claim 1, wherein the diameter of the funnel's upper end portion is much greater than the diameter of the stem.

7. The oil change kit apparatus of claim 1, wherein rotation of the funnel changes its elevation.

8. The oil change kit apparatus of claim 1, wherein the conically shaped support removably attaches to the receptacle base.

9. The oil change kit apparatus of claim 1, wherein the upper annular sidewall edge is generally smooth and the conically shaped support has a plurality of lower end portions that fit the annular edge.

10. An oil change kit apparatus for use when changing the oil and oil filter of an oil lubricated vehicle engine, comprising:

a) a receptacle base having a bottom, sidewall and interior for containing oil that is drained from a vehicle engine, the sidewall having an upper annular edge;

b) a conically-shaped support that is removably supported by the receptacle, the support having a central hub and a plurality of radially extending, circumferentially spaced struts extending from said hub;

c) the hub having a central opening;

d) a funnel that adjustably fits the hub central opening, the funnel having an elongated stem portion of a first smaller diameter with a hollow bore, and a upper end portion of an second, larger diameter funnel mounted on the top of the stem portion, the funnel having an inner catch basin that communicates with the stem bore so that fluids draining from an automobile engine into the catch basin can travel via the stem bore to the receptacle base;

e) the funnel stem being movable into multiple, vertically spaced apart positions that vary the elevation of the catch basin relative to the bottom of the receptacle base; and f) wherein the receptacle base has a pour spout at the upper annular edge that enables oil to be poured out of the base when the conically shaped support and funnel are separated from the base.

11. An oil change kit apparatus for use when changing the oil and oil filter of an oil lubricated vehicle engine, comprising:

a) a receptacle base having a bottom, sidewall and interior for containing oil that is drained from a vehicle engine, the sidewall having an upper annular edge;

b) a funnel support that removably fits the receptacle base, said funnel support having a lower end portion that fits the receptacle base and an upper end portion with a supporting portion that can support a funnel, the upper end portion extending above the annular edge of the receptacle base, the lower end portion being of a much greater diameter than the upper end portion;

c) a funnel that adjustably fits the hub central opening, the funnel having an elongated stem portion of a first smaller diameter with a hollow bore, and a upper end portion of a second, larger diameter funnel mounted on the top of the stem portion, the funnel having an inner catch basin that communicates with the stem bore so that fluids draining from an automobile engine into the catch basin can travel via the stem bore to the receptacle base;

d) the funnel stem being movable into multiple, vertically spaced apart positions that vary the elevation of the catch basin relative to the bottom of the receptacle base; and e) wherein the receptacle base has a pour spout at the upper annular edge that enables oil to be poured out of the base when the conically shaped support and funnel are separated from the base.

* * * * *